US011214969B2

(12) United States Patent
Psaila

(10) Patent No.: US 11,214,969 B2
(45) Date of Patent: Jan. 4, 2022

(54) TILE SPACING PLATE FOR LIPPAGE CONTROL

(71) Applicant: ATR Plastics Pty Ltd, Tullamarine (AU)

(72) Inventor: Andy Psaila, Tullamarine (AU)

(73) Assignee: ATR PLASTICS PTY LTD, Tullamarine (AU)

( * ) Notice: Subject to any disclaimer, the term of this patent is extended or adjusted under 35 U.S.C. 154(b) by 0 days.

(21) Appl. No.: 17/054,336

(22) PCT Filed: May 10, 2019

(86) PCT No.: PCT/AU2019/050432
§ 371 (c)(1),
(2) Date: Nov. 10, 2020

(87) PCT Pub. No.: WO2019/213711
PCT Pub. Date: Nov. 14, 2019

(65) Prior Publication Data

US 2021/0164241 A1 Jun. 3, 2021

(30) Foreign Application Priority Data

May 11, 2018 (AU) ..... 2018901618

(51) Int. Cl.
*E04F 21/00* (2006.01)
*E04F 21/20* (2006.01)

(52) U.S. Cl.
CPC ..... *E04F 21/0092* (2013.01); *E04F 21/20* (2013.01)

(58) Field of Classification Search
CPC ... E04F 21/0092; E04F 21/22; E04F 21/1844; E04F 13/0892; E04F 15/02005; E04F 21/20
See application file for complete search history.

(56) References Cited

U.S. PATENT DOCUMENTS 7,257,926 B1 8/2007 Kirby
7,954,300 B1 * 6/2011 Kufner ..... E04F 21/22 52/749.11

(Continued)

FOREIGN PATENT DOCUMENTS

WO 2016201502 A1 12/2016

OTHER PUBLICATIONS

International Search Report & Written Opinion dated Jul. 25, 2019 from PCT Application No. PCT/2019/050432.

*Primary Examiner* — Babajide A Demuren
(74) *Attorney, Agent, or Firm* — Innovation Capital Law Group, LLP; Vic Lin

(57) ABSTRACT

A spacing plate for tile lippage control has a base plate and at least one spacing member extending perpendicularly from an upper surface thereof. At least one spacing member comprises a pair of parallel elongate spacer walls defining parallel outer facing spacing control faces and the elongate spacer walls are spaced apart to define an elongate gap therebetween. As such, the spacing members may flexibly slightly to account for slight horizontal misalignments. Furthermore, edges of the baseplate may comprise cutouts dividing the baseplate into independently flexing leaves which can flexibly engage under individual tiles to account for slight vertical misalignments.

20 Claims, 6 Drawing Sheets

(56) References Cited

U.S. PATENT DOCUMENTS

| | | | | |
|---|---|---|---|---|
| 8,429,879 | B1 * | 4/2013 | Hoffman | E04F 21/0092 52/747.11 |
| 2008/0236094 | A1 * | 10/2008 | Doda | E04F 21/22 52/749.11 |
| 2010/0263304 | A1 * | 10/2010 | Torrents I Comas | E04F 21/0092 52/126.5 |
| 2014/0298736 | A1 * | 10/2014 | Bunch | E04F 21/0092 52/126.1 |
| 2014/0325936 | A1 | 11/2014 | Psaila et al. | |
| 2019/0218797 | A1 * | 7/2019 | Lin | E04F 13/0892 |

* cited by examiner

TILE SPACING PLATE FOR LIPPAGE CONTROL

FIELD OF THE INVENTION

This invention relates generally to tile spacing apparatus more particularly, this invention relates to a tile spacing plate for lippage control.

BACKGROUND OF THE INVENTION

Tile lippage control apparatus may have a clamp member which urges downwardly against an opposing base plate, thereby clamping edges of tiles therebetween for ensuring edge conformity.

The present invention seeks to provide improvements to this type of lippage apparatus, which will overcome or substantially ameliorate at least some of the deficiencies of the prior art, or to at least provide an alternative.

It is to be understood that, if any prior art information is referred to herein, such reference does not constitute an admission that the information forms part of the common general knowledge in the art, in any country.

SUMMARY OF THE DISCLOSURE

There is provided herein a tile spacing plate which clamps against an associated clamping device to align corners or edges of adjacently arranged tiles and which has an orthogonal arrangement of spacer members to space the edges apart. The spacing plate may be made of plastic and disposability left in place under the tiles when covered with grout.

The tile spacing plate comprises a base plate which is laid atop a prepared surface comprising adhesive. Spacing members extending perpendicularly from an upper surface of the base plate each define parallel outer spacing control faces against which side edges of the tiles abut for spacing control.

In this way, when tiles are placed atop an upper surface of the base plate, the spacing control faces of the spacing members control the appropriate spacing between the tiles and the clamping member engaging the base plate thereunderneath controls the lippage thereof.

As slight variations in horizontal alignment or tile width imperfections may result in tiles going out of alignment over a distance, the spacing plate may allow horizontal spacing tolerance.

Specifically, each spacing member may comprise a pair of parallel and elongate spacer walls defining the outer facing spacing control faces. Furthermore, the elongate spacer walls may be spaced apart to allow an elongate gap therebetween. As such, these spacing members may vary in width and/or flex slightly so as to allow for fine horizontal adjustment.

Furthermore, the elongate gap receives grout therein during tile finishing, thereby enhancing purchase thereof, reducing or preventing dislodgement therefrom over time.

Furthermore, as individual tiles may have a thickness imperfections which may hinder proper lippage control using conventional clamping-type lippage control apparatus, edges of the present base plate may be bisected by cutouts, thereby dividing the baseplate into independently flexing leaves. The cutouts may coincide with the spacing members such that the leaves are formed between adjacent spacing members.

As such, each flexing leaf may flex substantially independently to account for thickness imperfections of an individual tile.

Each flexing leaf may narrow towards a distal tip thereof and the upper and under surfaces of the baseplate may be convex such that the distal tip extends up between the adjacent spacing members. Furthermore, the flexing leaves may have a greater radial extent as compared to the spacing members such that each flexing leaf is adequately flexibly poised underneath each tile corner and is able to flex substantially independently of the other leaves to account for individual tile imperfections.

Each leaf may comprise adhesive ports to enhance adhesion of tiles directly to the floor surface thereunderneath.

The spacer walls may meet at distal end of each spacer member including by way of a buttress having a thickness greater than twice the width of each spacer walls, thereby providing structural reinforcement for each spacing member.

The spacer members may meet orthogonally at a central portion having a screw hole aperture for a screw shaft of the clamping device. Upper surfaces of distal ends of the spacer walls may lie lower than an upper surface of the central portion to accommodate more a greater volume of grout.

Distal ends of each spacer member may extend above each respective cutout, thereby maximising the length of each spacer member yet not interfering with the independent flexing of the leaves across the cutout.

Each elongate gap may extend over a respective cutout, thereby allowing grout to flow underneath distal ends of each spacer member.

The spacing members may be provided in quadrant, three wherein two-way configurations and provided in 2 mm, 3 mm and 5 mm spacing variants.

According to one aspect, there is provided a spacing plate for tile lippage control, the spacing plate comprising a base plate and at least one spacing member extending perpendicularly from an upper surface thereof wherein the at least one spacing member comprises a pair of parallel elongate spacer walls defining parallel outer facing spacing control faces and wherein the elongate spacer walls are spaced apart to define an elongate gap therebetween.

The elongate spacer walls may meet at distal ends thereof.

The elongate spacer walls may meet at a buttress, the buttress having a thickness greater than twice the width of each spacer wall.

The elongate spacer walls may meet at a central portion comprising a screw hole aperture for a screw shaft of a reusable clamping device.

A top surface of a distal end of the at least one spacing member lies below a top surface of the central portion.

At least one edge of the baseplate may be bisected by a cutout forming flexing leaves either side thereof.

The cutout may coincide with the at least one spacing member such that the flexing leaves are formed either side of the at least one spacing member.

A distal end of the at least one spacing member may extend over the cutout.

The elongate gap of the at least one spacing member may extend over the cutout.

The flexing leaves may have a radial extent greater than that of the at least one spacing member.

The at least one edge may curve inwardly towards the cutout.

Each flexing leaf may comprises an adhesive port therethrough.

Each leaf may narrow towards a distal tip.

Each flexing leaf may curve upwardly.

At upper surface of the distal tip may extend up above a bottom edge of the at least one spacing member.

Upper and undersurfaces of the baseplate are convex and wherein the upper surface has a greater radius of curvature as compared to that of the undersurface.

The at least one spacing member may comprise four orthogonal spacing members.

The at least one spacing member may comprise two spacing members in line and a third spacing member extending orthogonally from a midpoint thereof.

The at least one spacing member may comprise two spacing members in line.

According to another aspect, there is provided a spacing plate for tile quadrant lippage control, the spacing plate comprising a base plate and an orthogonal quadrant of four spacing members extending perpendicularly from an upper surface thereof wherein each spacing member comprises a pair of elongate and parallel spacer walls defining parallel outer facing spacing control faces and wherein the elongate spacer walls are spaced apart to define an elongate gap therebetween and wherein each of four edges of the baseplate is bisected by a cutout forming four flexing leaves and wherein each cutout coincides with a respective spacing member such that each of the four flexing leaves locates between respectively adjacent spacing members and wherein the leaves have greater radial extent as compared to the spacing members.

Other aspects of the invention are also disclosed.

BRIEF DESCRIPTION OF THE DRAWINGS

Notwithstanding any other forms which may fall within the scope of the present invention, preferred embodiments of the disclosure will now be described, by way of example only, with reference to the accompanying drawings in which.

DESCRIPTION OF EMBODIMENTS

Figure 1:
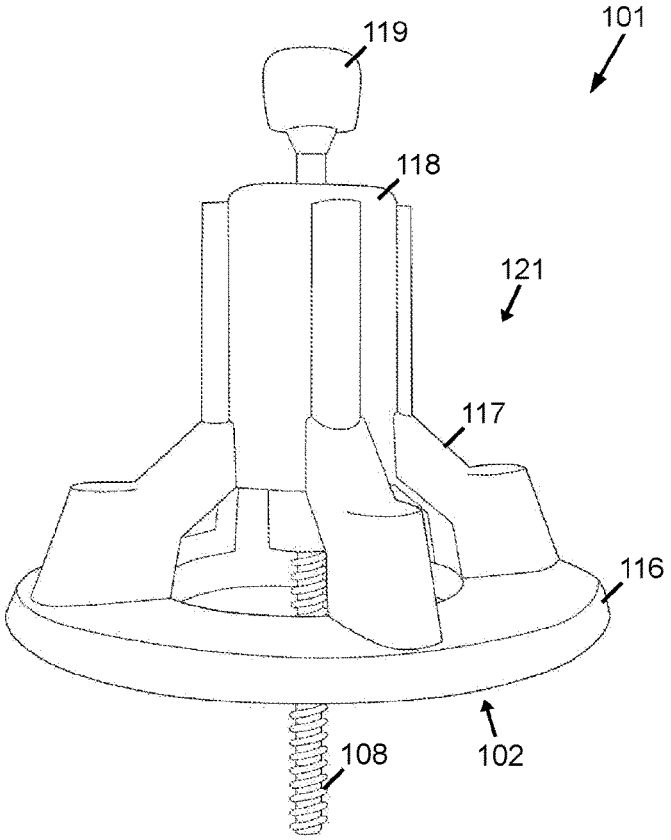
FIGS. 1 and 2 show tile lippage control apparatus comprising a clamping member which selectively engages with a tile spacing plate in accordance with an embodiment.

Tile lippage control apparatus comprises a reusable clamping device 101 having a screw shaft 108 which fastens within a central screw hole 111 of a spacing plate 100.

The clamping device 101 comprises a body 121 having a barrel 118 through which the screw shaft 108 rotates. The barrel 118 supports an annular base 116 via struts 117 so as to define a downward urging clamping face 102. The spacing plate 100 comprises a base 120 defining an upward urging clamping face 103.

The barrel 118 and the struts 117 may be shaped to facilitate gripping thereof and wherein the screw shaft 118 may comprise a roughened head 119 to facilitate rotation of the screw shaft 108 with respect to the body 121.

The spacing plate 100 comprises at least one elongate spacing member 107 extending perpendicularly from an upper surface of the base plate 120. The spacing member 107 defines opposing outer spacing control faces 112.

In use, adhesive may be applied to a prepared surface and the spacing plate 110 placed thereatop in the orientation given in FIG. 1. Tiles may be placed atop the base plate 120 of the device 110 to abut against the opposing outer spacing control faces 112 of the spacer walls 108 for spacing control.

The height of the spacing members 107 may be less than that of the height of the tiles for which the apparatus is to be used so as to allow the spacing plate 100 to be concealed with grout between the tiles when left in place.

The distal end of the screw shaft 108 is inserted between the arranged tiles into the screw hole 111 and tightened therein by rotating the roughened head 119 of the screw shaft 108 clockwise with respect to the body 121 of the clamping device 108 which remains static. As the distal end of the screw shaft 118 screws into the screw hole 111, the downward clamp face 102 is urged towards the upward clamp face 103 so as to clamp the tiles therebetween, ensuring lippage conformity between the adjacently arranged tiles.

In the preferred embodiment shown, the at least one space member 107 comprises a pair of spacer walls 108 defining the outer spacer faces 112. The spacer walls 108 are spaced apart to allow an inner elongate gap 109 (such as of less than 2 mm in width in embodiments) therebetween.

The gap 109 allows the spacer walls 108 to flex slightly together, thereby providing horizontal spacing tolerance between the adjacent edges of tiles.

Furthermore, the gap 109 may fill with grout, providing a sufficiently deep bed therefor, allowing for the adequate anchoring and purchase of the grout therein, preventing or reducing the likelihood of the grout being inadvertently dislodged therefrom in use.

Distal ends of the spacer walls 108 may meet. Preferably, distal end of the spacer walls 108 meet at buttresses 115 which preferably have rounded distal faces. The buttresses 115 preferably have a thickness (both radially and/or tangentially) twice that of the width of each wall 108.

The walls 108 may meet at a central portion 122. The buttress 115 and the central portion 112 provide structural support for the spacing members 107 and the screw hole 111.

Figure 4:
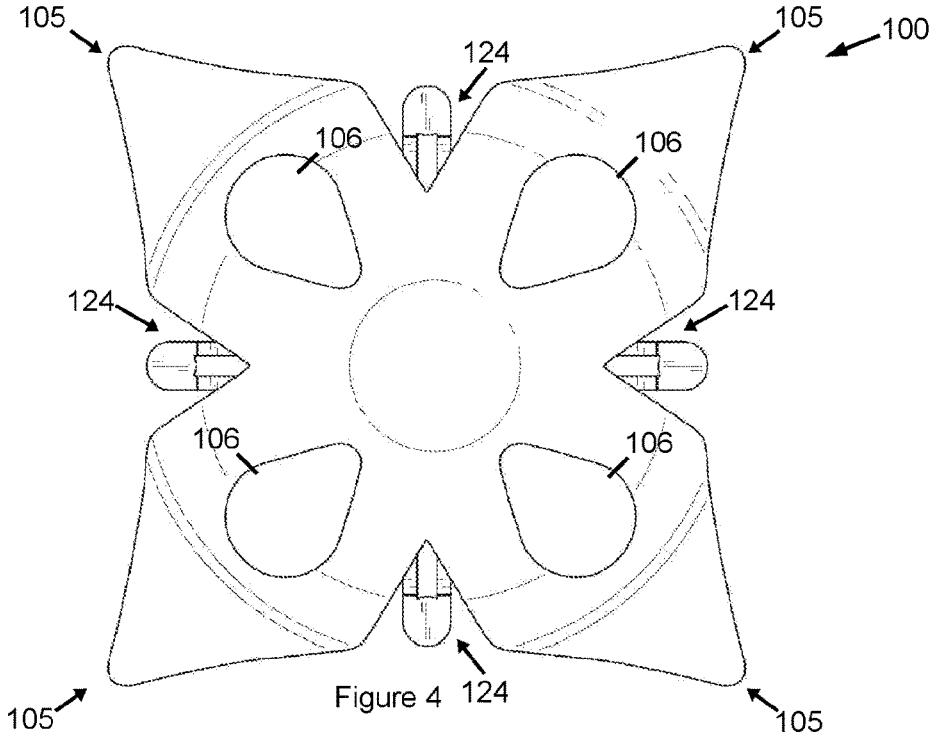
FIG. 4 shows a bottom plan view of the tile spacing plate of FIG. 2.

Furthermore, as can be seen for example from FIG. 4, the central screw hole 111 preferably does not run through the base plate 120, ensuring the undersurface of the base plate 120 lies flush against the prepared surface and furthermore avoids penetration of floor surface plastic water membranes.

Figure 2:
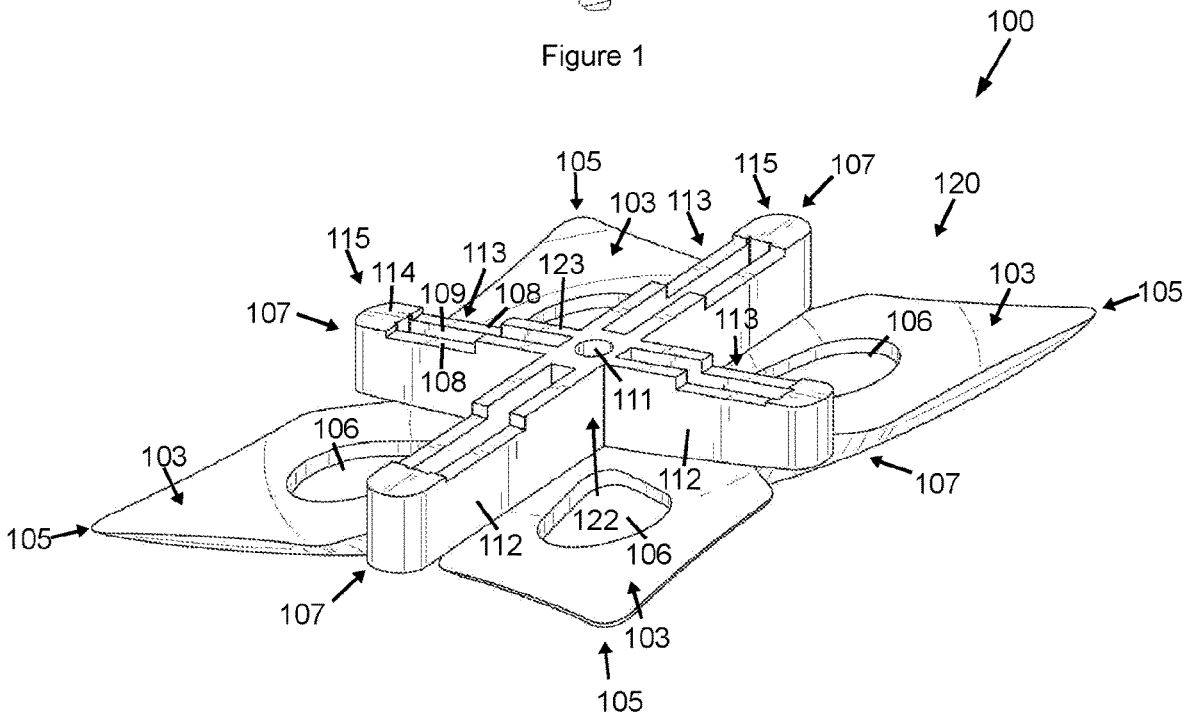
Figure 3:
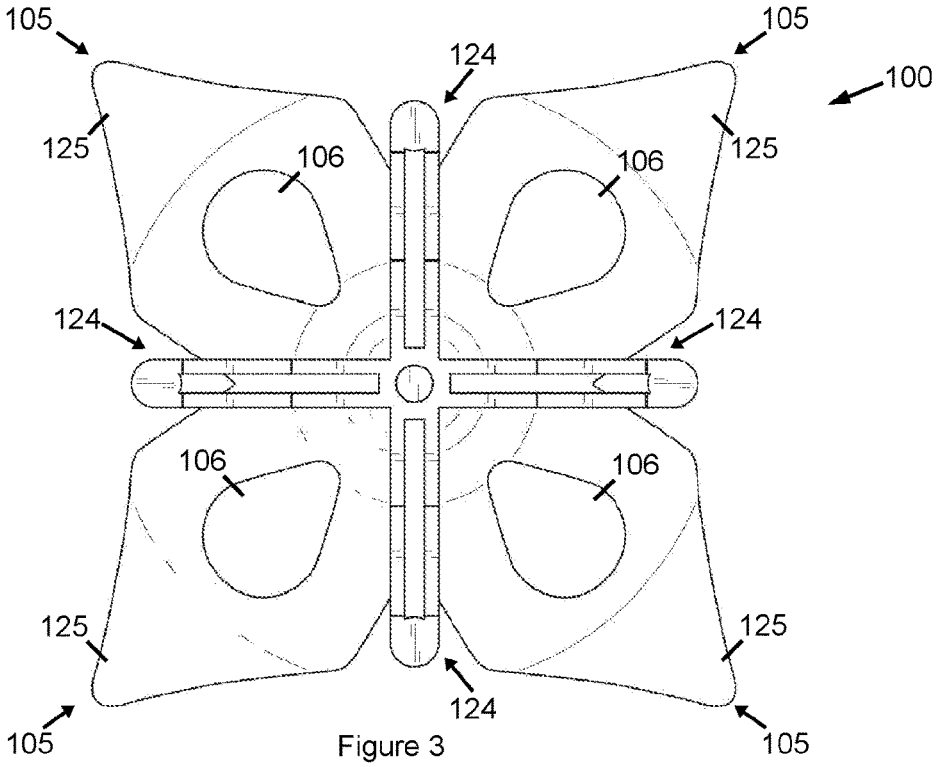
FIG. 3 shows a top plan view of the tile spacing plate of FIG. 2.

In the embodiments shown in FIG. 2, the plate 100 comprises four spacing members 107 for spacing a quadrant of adjacent tiles.

Figure 6:
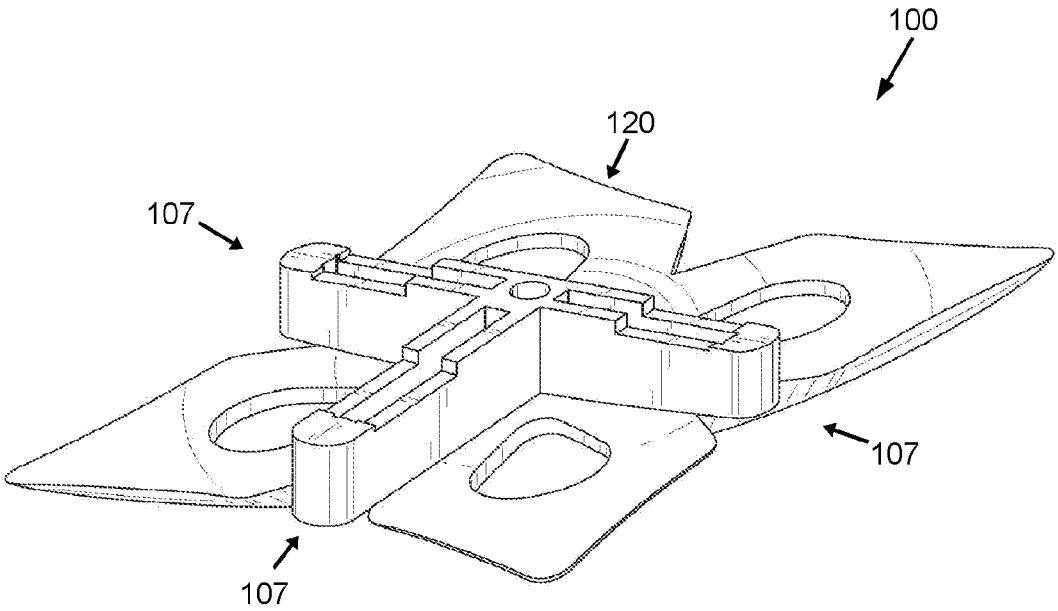
FIG. 6 shows a top perspective view of an embodiment of the tile spacing plate configured for spacing of three adjacent tiles in accordance with an embodiment.
Figure 7:
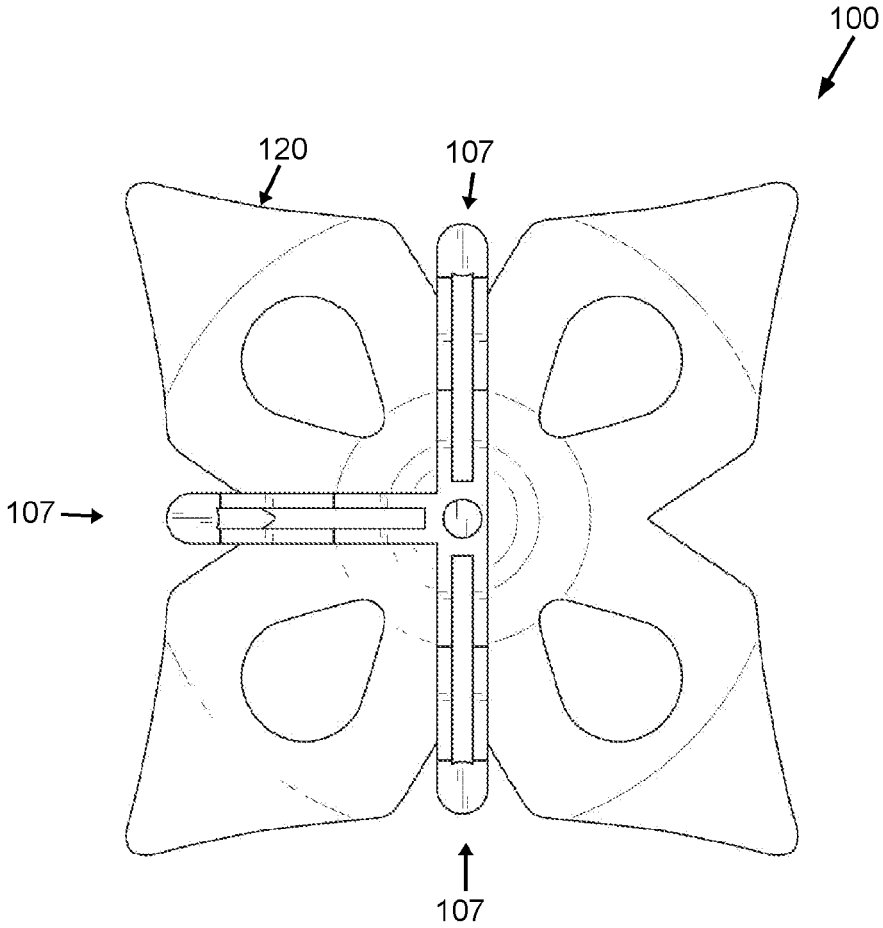
FIG. 7 shows a top plan view of the tile spacing plate of FIG. 6.
Figure 8:
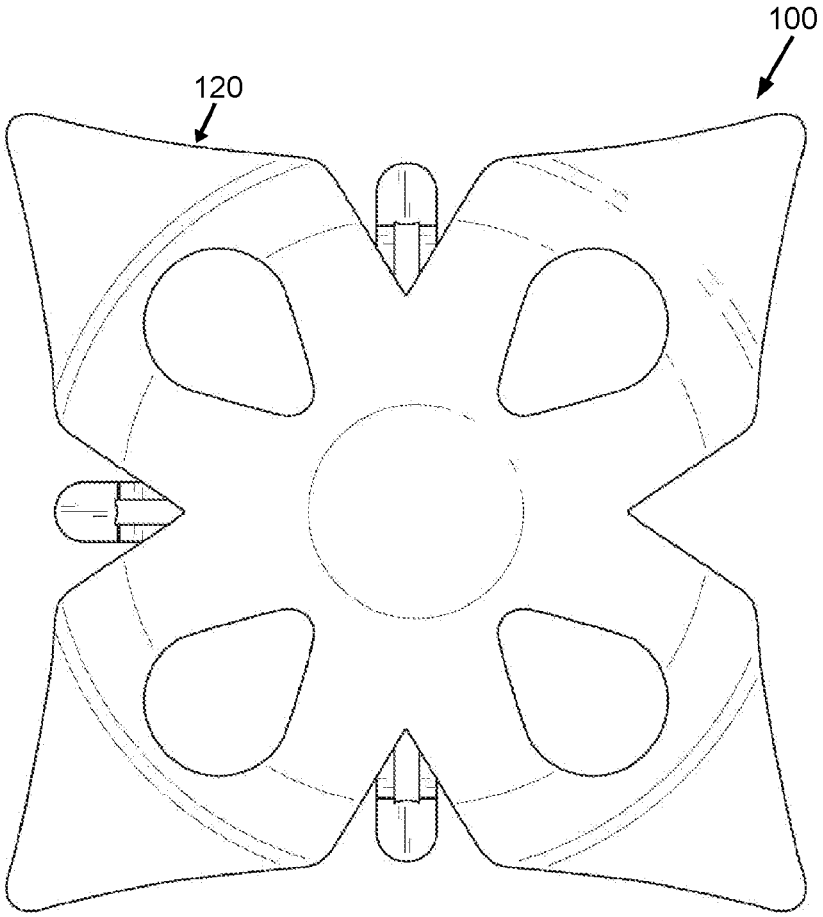
FIG. 8 shows a bottom plan view of the tile spacing plate of FIG. 6.
Figure 9:
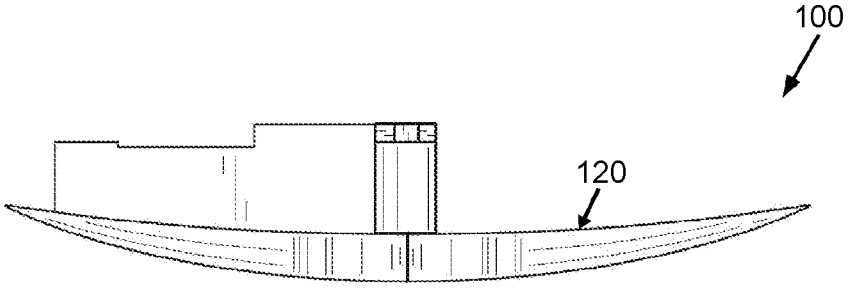
FIG. 9 shows a side elevation view of the tile spacing plate of FIG. 6.

However, FIG. 6 illustrates an embodiment of the plate 100 comprising an arrangement of spacing members 107 configured for spacing arrangement of three tiles. Specifically, the embodiment of FIG. 6 comprises two spacing members 107 arranged in line and a third spacing member extending orthogonally from a midpoint thereof.

Figure 10:
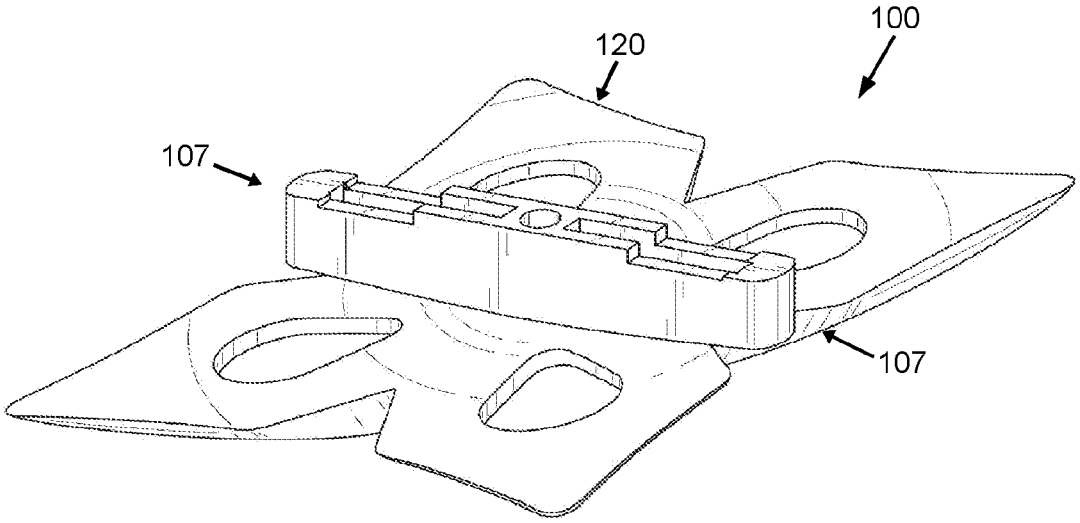
FIG. 10 shows a top perspective view of an embodiment of the tile spacing plate configured for spacing of two adjacent tiles in accordance with an embodiment.
Figure 11:
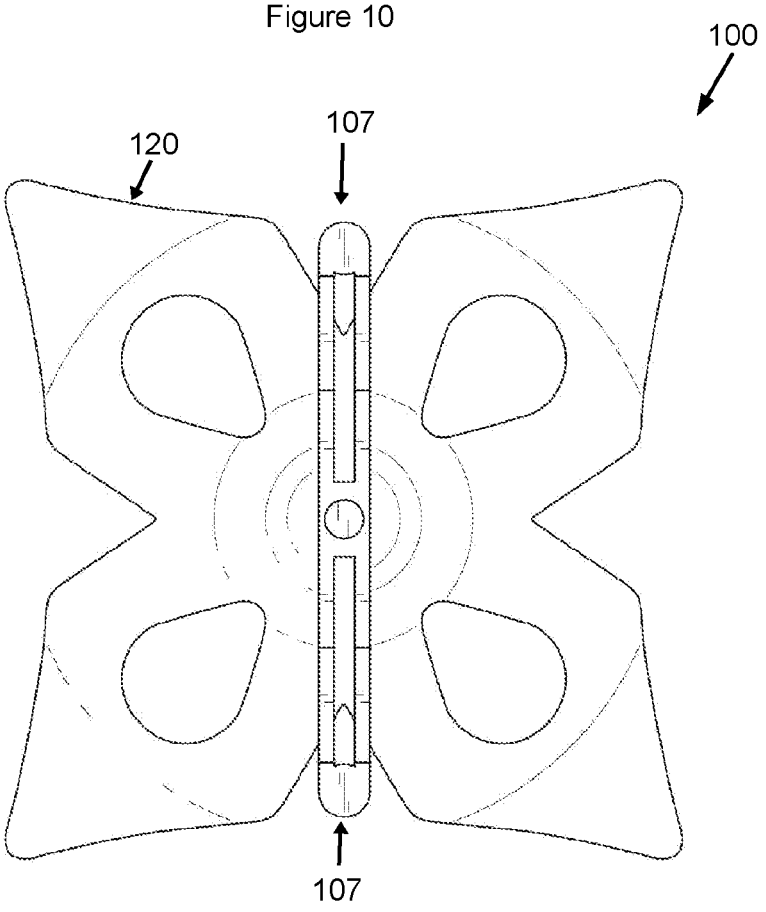
FIG. 11 shows a top plan view of the tile spacing plate of FIG. 10.
Figure 12:
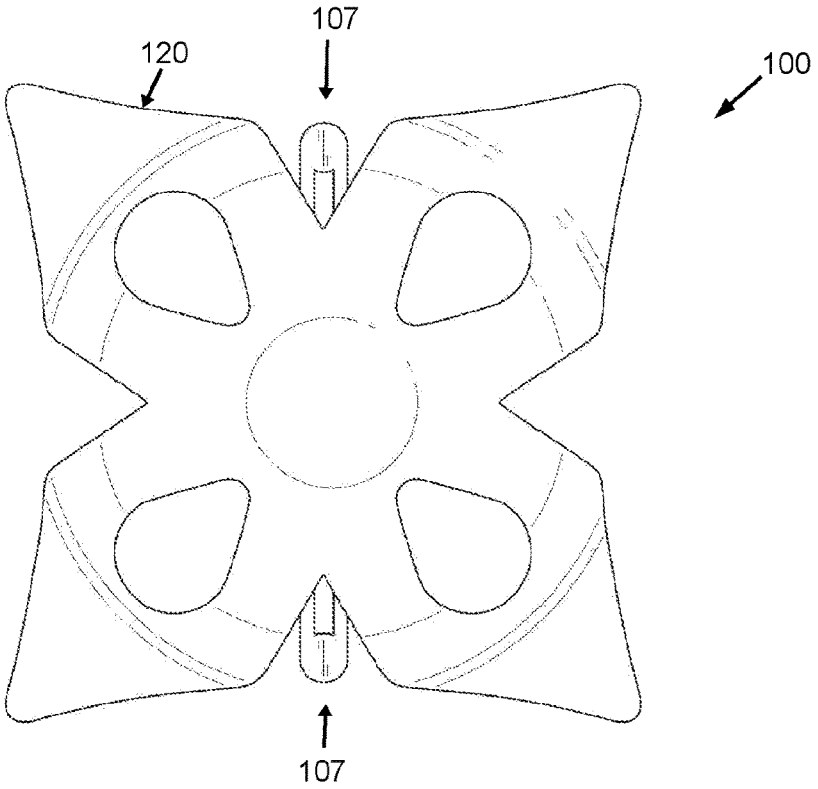
FIG. 12 shows a bottom plan view of the tile spacing plate of FIG. 10.
Figure 13:
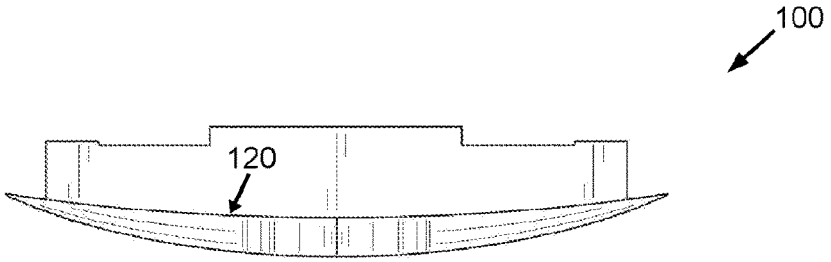
FIG. 13 shows a side elevation view of the tile spacing plate of FIG. 10.
Figure 14:
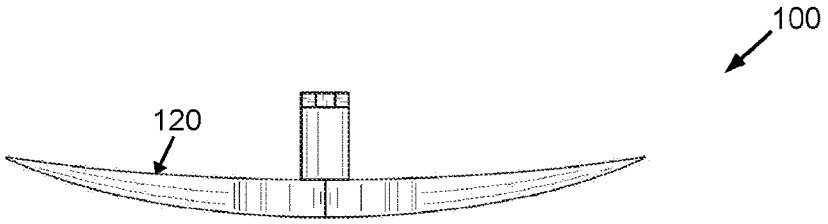
FIG. 14 shows an orthogonal side elevation view of the tile spacing plate of FIG. 10.

Furthermore, the embodiments shown in FIG. 10 comprises an arrangement of spacing members 107 configured for spacing a pair of adjacent tiles. Specifically, in accordance with this embodiment, the spacing members 107 comprise a pair of spacing members 107 arranged in line.

With reference to FIG. 1, in embodiments, the elevation of the central portion 122 may predominate for enhance structural integrity and engagement of the screw shaft 108. Specifically, upper surfaces 114 of the buttresses 115 may lie lower then corresponding upper surfaces 123 of the central portion 122. In embodiments, upper surfaces of the walls 108 may lie lower than that of the adjacent buttresses 115, thereby defining indentations 113 between the surfaces of the buttresses 115 and the central portion 122.

In embodiments, the base plate 120 may comprise adhesive flow ports 106 therethrough allowing the adhesive thereunderneath to contact the tile the above for adequate adhesion.

In a preferred embodiment, at least one edge of the base plate 120 bisected by a cut out 124. The cut out 124 may be substantially V-shaped. The cut out 124 divides adjacent portions of the baseplate 122 into independently flexing leaves 105.

In an embodiment shown, each of the four edges of the baseplate 120 comprises a bisecting cut out 124 substantially midway therealong thereby forming a quadrant of four independently flexing leaves 105.

Each cut out 124 preferably coincides with a distal end of each spacing member 107 such that the flexing leaves 105 are formed between orthogonally adjacent spacing members 107.

Distal ends of the spacing members 107 may extend above each cut out 124. Furthermore, the elongate gap 109 therealong may extend above each cut out 124.

Each edge of the baseplate 124 may curve inwardly towards the cut out 124. Furthermore, distal tips 125 of the flexing leaves 105 may have a greater radial extent than that of the spacer members 107.

Furthermore, the leaves 105 may tapered towards the tips 125.

Figure 5:
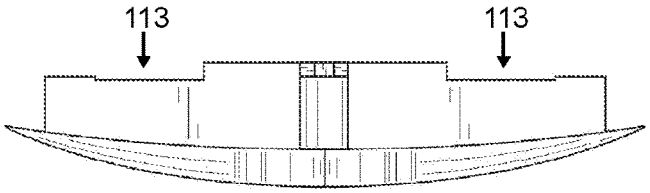
FIG. 5 shows a side elevation view of the tile spacing plate of FIG. 2.

As can be appreciated from FIG. 5, the baseplate 120 may comprise a curvature. Specifically, the upper surface and the lower surface may be convex with the upper surface having a greater radius of curvature than that of the lower surface. As such, the tips 125 may extend between the orthogonally adjacent spacer members 107. In other words, an upper surface of each tip 105 may locate above a bottom edge of the at least one adjacent spacing member 107.

The base plate 100 may be provided in variants having spacer members 107 of thicknesses for 2 mm, 3 mm and 5 mm spacings.

As can be appreciated from the foregoing, the elongate gap 109 along each spacing member 107 allows each spacing member to flex and vary in width to account for horizontal alignment imperfections.

Furthermore, the elongate gap 109 is able to receive grout therein during tile finishing, thereby enhancing the purchase thereof and reducing inadvertent dislodgement therefrom.

The thicker buttresses 112 and central portion 122 provide structural support for the spacing plate 100 and for engaging the shaft of the thumb screw 108.

Furthermore, the central screw hole 111 preferably does not pass through the base plate 120 such that the thumb screw 108 does not pierce a substrate waterproofing membrane thereunderneath.

The adhesive flow ports 106 through the base plate 120 enhance adhesion of adhesive directly between the floor surface and the undersurface of the tile.

Furthermore, the edge cutouts 124 divide the base plate 120 into leaves 105 which are able to independently flex at respective tile corners to account for vertical alignment and/or thickness imperfections of individual tiles. The edge cutouts 124 are preferably located at distal ends of the spacer members 107 such that each flexing leaf 105 is defined under a respective tile corner.

The elongate gaps 109 of the spacer members 107 may extend over the edge cutouts 124 such that grout may flow directly therethrough to the floor surface underneath distal ends of the spacer members 107.

The foregoing description, for purposes of explanation, used specific nomenclature to provide a thorough understanding of the invention. However, it will be apparent to one skilled in the art that specific details are not required in order to practice the invention. Thus, the foregoing descriptions of specific embodiments of the invention are presented for purposes of illustration and description. They are not intended to be exhaustive or to limit the invention to the precise forms disclosed; obviously, many modifications and variations are possible in view of the above teachings. The embodiments were chosen and described in order to best explain the principles of the invention and its practical applications, they thereby enable others skilled in the art to best utilize the invention and various embodiments with various modifications as are suited to the particular use contemplated. It is intended that the following claims and their equivalents define the scope of the invention.

The invention claimed is:

1. A spacing plate for tile lippage control, the spacing plate comprising a base plate and at least one spacing member extending perpendicularly from an upper surface thereof wherein the at least one spacing member comprises a pair of parallel elongate spacer walls defining parallel outer facing spacing control faces and wherein the elongate spacer walls are spaced apart to define an elongate gap therebetween, wherein the elongate spacer walls meet at a central portion comprising a screw hole aperture for a screw shaft of a reusable clamping device and wherein a top surface of a distal end of the at least one spacing member lies below a top surface of the central portion.

2. The spacing plate as claimed in claim 1, wherein the elongate spacer walls meet at distal ends thereof.

3. The spacing plate as claimed in claim 2, wherein the elongate spacer walls meet at a buttress, the buttress having a thickness greater than twice the width of each spacer wall.

4. The spacing plate as claimed in claim 1, wherein at least one edge of the baseplate is bisected by a cutout forming flexing leaves either side thereof.

5. The spacing plate as claimed in claim 4, wherein the cutout coincides with the at least one spacing member such that the flexing leaves are formed either side of the at least one spacing member.

6. The spacing plate as claimed in claim 5, wherein a distal end of the at least one spacing member extends over the cutout.

7. The spacing plate as claimed in claim 5, wherein the elongate gap of the at least one spacing member extends over the cutout.

8. The spacing plate as claimed in claim 6, wherein the flexing leaves have a radial extent greater than that of the at least one spacing member.

9. The spacing plate as claimed in claim 6, wherein the at least one edge curves inwardly towards the cutout.

10. The spacing plate as claimed in claim 4, wherein each flexing leaf comprises an adhesive port therethrough.

11. The spacing plate as claimed in claim 4, wherein each leaf narrows towards a distal tip.

12. The spacing plate as claimed in claim 11, wherein each flexing leaf curves upwardly.

13. The spacing plate as claimed in claim 12, wherein at upper surface of the distal tip extends up above a bottom edge of the at least one spacing member.

14. The spacing plate as claimed in claim 4, wherein upper and undersurfaces of the baseplate are convex and wherein the upper surface has a greater radius of curvature as compared to that of the undersurface.

15. The spacing plate as claimed in claim 1, wherein the at least one spacing member comprises four orthogonal spacing members.

16. The spacing plate as claimed in claim 1, wherein the at least one spacing member comprise two spacing members in line and a third spacing member extending orthogonally from a midpoint thereof.

17. The spacing plate as claimed in claim 1, wherein the at least one spacing member comprise two spacing members in line.

18. A spacing plate for tile quadrant lippage control, the spacing plate comprising a base plate and an orthogonal quadrant of four spacing members extending perpendicularly from an upper surface thereof wherein each spacing member comprises a pair of elongate and parallel spacer walls defining parallel outer facing spacing control faces and wherein the elongate spacer walls are spaced apart to define an elongate gap therebetween and wherein each of four edges of the baseplate is bisected by a cutout forming four flexing leaves and wherein each cutout coincides with a respective spacing member such that each of the four flexing leaves locates between respectively adjacent spacing members and wherein the leaves have greater radial extent as compared to the spacing members.

19. A spacing plate for tile lippage control, the spacing plate comprising:

a base plate and at least one spacing member extending perpendicularly from an upper surface thereof, wherein the at least one spacing member comprises a pair of parallel elongate spacer walls defining parallel outer facing spacing control faces, the elongate spacer walls are spaced apart to define an elongate gap therebetween, at least one edge of the baseplate is bisected by a cutout forming flexing leaves either side thereof, the cutout coincides with the at least one spacing member such that the flexing leaves are formed either side of the at least one spacing member, and a distal end of the at least one spacing member extends over the cutout.

20. A spacing plate for tile lippage control, the spacing plate comprising:

a base plate and at least one spacing member extending perpendicularly from an upper surface thereof, wherein the at least one spacing member comprises a pair of parallel elongate spacer walls defining parallel outer facing spacing control faces, wherein the elongate spacer walls are spaced apart to define an elongate gap therebetween, wherein at least one edge of the baseplate is bisected by a cutout forming flexing leaves either side thereof, wherein the cutout coincides with the at least one spacing member such that the flexing leaves are formed either side of the at least one spacing member, and the elongate gap of the at least one spacing member extends over the cutout.

* * * * *